United States Patent [19]

Holyoke

[11] 4,225,128

[45] Sep. 30, 1980

[54] FOLDING MACHINE

[75] Inventor: Robert H. Holyoke, Buffalo Grove, Ill.

[73] Assignee: General Binding Corporation, Northbrook, Ill.

[21] Appl. No.: 658,877

[22] Filed: Feb. 18, 1976

Related U.S. Application Data

[63] Continuation of Ser. No. 525,082, Nov. 18, 1974, abandoned.

[51] Int. Cl.[3] ..... B65H 45/14

[52] U.S. Cl. ..... 270/68 A

[58] Field of Search ..... 270/68 A, 68 R

[56] References Cited

U.S. PATENT DOCUMENTS

| | | | |
|---|---|---|---|
| 1,716,936 | 6/1929 | Waterworth | 270/68 A |
| 1,843,763 | 2/1932 | Davidson | 270/68 A |
| 2,847,209 | 8/1958 | Olson | 270/68 A |
| 3,021,134 | 2/1962 | Appell | 270/68 A |
| 3,089,695 | 5/1963 | Brooks | 270/68 A |
| 3,150,871 | 9/1964 | Boblit | 270/68 A |
| 3,178,171 | 4/1965 | Springer | 270/68 A |

*Primary Examiner*—Edward M. Coven
*Assistant Examiner*—A. Heinz
*Attorney, Agent, or Firm*—Hill, Van Santen, Steadman, Chiara & Simpson

[57] ABSTRACT

A folding machine for producing folds in paper sheets and the like of varying numbers and dimensions and equipped with a plurality of main rolls and adjustable roll combinations wherein each adjustable roll is adjustable independently of its associated main roll and independently of all of the other adjustable rolls and including means for providing such independent adjustment to achieve desired nip and amount of pressure between interacting rolls.

1 Claim, 6 Drawing Figures

FOLDING MACHINE

This is a continuation of application Ser. No. 525,082, filed Nov. 18, 1974, now abandoned.

This invention relates to paper folding machines and particularly to means for setting up and adjusting such machines.

Traditionally, folding machines have included an arrangement wherein the sheet product, typically paper, proceeds through a train of rollers, fold plates, adjustable back stops, and/or deflectors to produce a product having a variety of folds, a number of folds and varying dimensions from fold to fold and combinations thereof. A typical drive train might contain one fixed main drive roll and five driven adjustable rolls. In a typical arrangement, the adjustable rolls are adjusted independently of each other for gap and amount of spring pressure between interacting rolls. Each adjustable roll has dual functioned and coaxially acting gap and pressure mechanism at each end of the individual roll. Early designers of such an arrangement undoubtedly attempted to keep the number of rolls to a minimum but to change gap and spring pressures were forced to provide additional mechanisms which were capable of angularly adjusting the rolls in their relationship to one another. Thus, each roll adjustment was dependent upon the previous adjustments made to its coacting roll.

It will be appreciated that one of the problems with the above described arrangement in the folding apparatus is the difficulty in setting up a machine to run. If any one of the adjustable rolls is adjusted to provide a different gap or spring pressure between it and its associated roll or rolls all or most of the remaining rolls must be similarly readjusted. After all of the readjustments have been made, test running usually indicates that minor adjustments are still required and if any roll setting is further modified all or most of the others must again be modified. It will be appreciated that in a shop where a variety of paper stocks are processed, the same tedious and highly inefficient procedure must be followed with each job change. Obviously, this is very wasteful of time and energy and the cost of down time for the machines for adjustment naturally increases.

Accordingly, it becomes desirable to provide some other means in a folding machine for adjustment of the rolls with respect to each other, which is more efficient and less time consuming and simpler to carry out.

SUMMARY OF THE INVENTION

It is a principal object of the invention, therefore, to provide an improved folding machine wherein the adjustment of interacting rolls may be simply carried out with a minimum of time.

A further object of the invention is to provide in a folding machine an arrangement comprising a plurality of main rolls and a cluster of adjustable rolls associated with each of said main rolls and wherein each of the adjustable rolls are independently adjustable with respect to the associated main roll and independently of each other.

It is another object of the invention to provide in a folding machine an arrangement of main rolls and associated adjustable rolls wherein each of the adjustable rolls may be individually adjusted for spring biasing against its associated main roll.

Another object of this invention is to provide in a folding machine linearly movable adjustment means for independently adjusting the position of each of the adjustable rolls with respect to their associated main roll.

By way of summary, it should be noted that the improvement to a folding machine herein contemplates equipping a folding machine with a plurality of main rolls, preferably four in number, and providing in association with each of those main rolls a pair of adjustable rolls. It is contemplated that no adjustment of any of the main rolls will need to be made. It is further contemplated that each of the adjustable rolls will be spring biased against their respective main rolls.

Other objects and advantages of the invention will become more apparent when considering the following description and the accompanying drawings.

Figure 1:
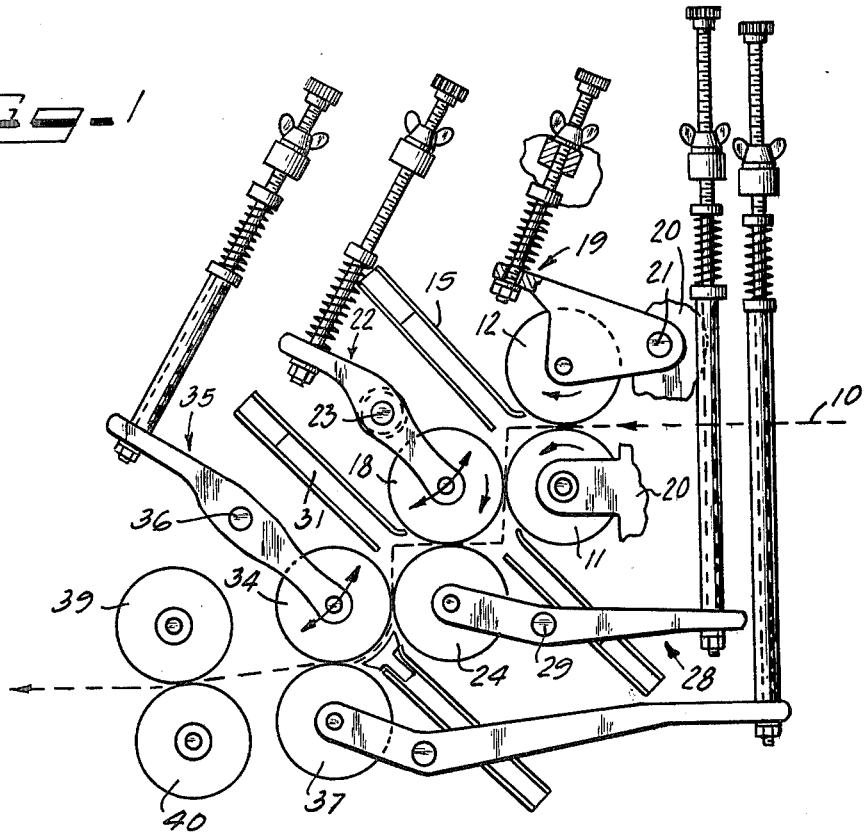
FIG. 1 is an end view in elevation of a typical drive train in a folding machine containing one fixed main drive roll and five driven adjustable rolls with certain of the adjustable rolls being adjustable with respect to the main roll and adjustable with respect to each other.

For purposes of understanding better the newly developed drive train arrangement embodying the invention herein, reference will first be made to the drive train arrangements shown in FIGS. 1 and 2 which illustrate a typical prior art construction. A sheet 10 to be folded is fed manually or automatically through main roll 11 and adjustable roll 12. It will be observed that roll 12 can be angularly adjusted as indicated by the curved arrow 13 for nip and/or pressure in its coaction with main roll 11. Designwise, the same adjustments could be made by moving the adjustable roll 12 outwardly and parallel to a line drawn between the centers of main roll 11 and 12 as indicated by the straight arrow 14. The sheet to be folded proceeds through roll pair 11 and 12 and into a fold plate 15 and stops at the adjustable back stop 16 in which a buckle occurs in the sheet in the area 17. The buckle snaps into the nip of roll pair comprising main roll 11 and adjustable roll 18. It will be observed that the adjustable roll 18 is angularly disposed against the main roll 11 similar to the situation previously described in connection with main roll 11 and adjustable roll 12. In the case of adjustable roll 12, an adjuster assembly 19 attached to roll 12, which may be pivotally mounted on the frame 20 at point 21, may be used to angularly position the adjustable roll 12. A similar adjuster assembly 22 may be pivotally mounted on the frame 20 at point 23 to angularly position the adjustable roll 18. Roll 18 could be similarly biased against main roll 11 in the manner of adjustable roll 12 except that it also is biased against roll 24 so that an adjustment of pressure at the nip of roll pair 11 and 18 automatically provides a new adjustment of pressure of roll 18 and 24 whether or not it is desired. After the buckle in the area 17 the sheet now bearing one fold exits from roll pair 11 and 18 and the folded edge enters fold plate 25 and is stopped by adjustable back stop 26. A buckle in the folded sheet occurs at area 27 and a new fold is nipped by roll pair 18 and 24. Another adjuster assembly 28 is pivotally mounted on the frame 20 at point 29 serves to carry adjustable roll 24, allowing the roll 24 to be angularly moved in the arc indicated by arrow 30.

The twice folded sheet exits from roll pair 18 and 24 and enters fold plate 31, is stopped by adjustable back stop 32, buckles in the area 33, and the new fold proceeds through the nip of roll pair 24 and 34. It will be observed that the adjustable roll 24 is angularly disposed against the roll 18 and the roll 34. Another adjuster assembly 35 is pivotally mounted on the frame 20 at 36. The roll 37 is disposed against the roll 34.

Now the product which has been folded three times exits from roll pair 34 and 24 and strikes deflector 38 which directs the product through roll pair 34 and 37. Subsequently, the product may be stored, perforated, both or neither by typical processing rolls 39 and 40 just prior to exit at point 41. Alternatively, if the deflector 38 is absent the thrice folded product could enter fold plate 42 instead of deflecting and a fourth fold would appear as a consequence of being stopped by back stop 43, buckling in the area 44 and finally be nipped by roll pair 34 and 37.

A deflector, such as shown at 38, may also be attached to fold plates 15, 25 and/or 31 in any combination to fold a product 0-4 times or perform a fold or folds at any fold plate or bypass any fold plate. Fold plates are commonly constructed with adjustable back stops 16, 26, 32 and 43 to control the depth of entry of the product to be folded and these fold plates also control where buckling will occur. By adjusting the position of the back stops a buckle or fold can be introduced into any portion of the sheet previously folded or not.

Figure 2:
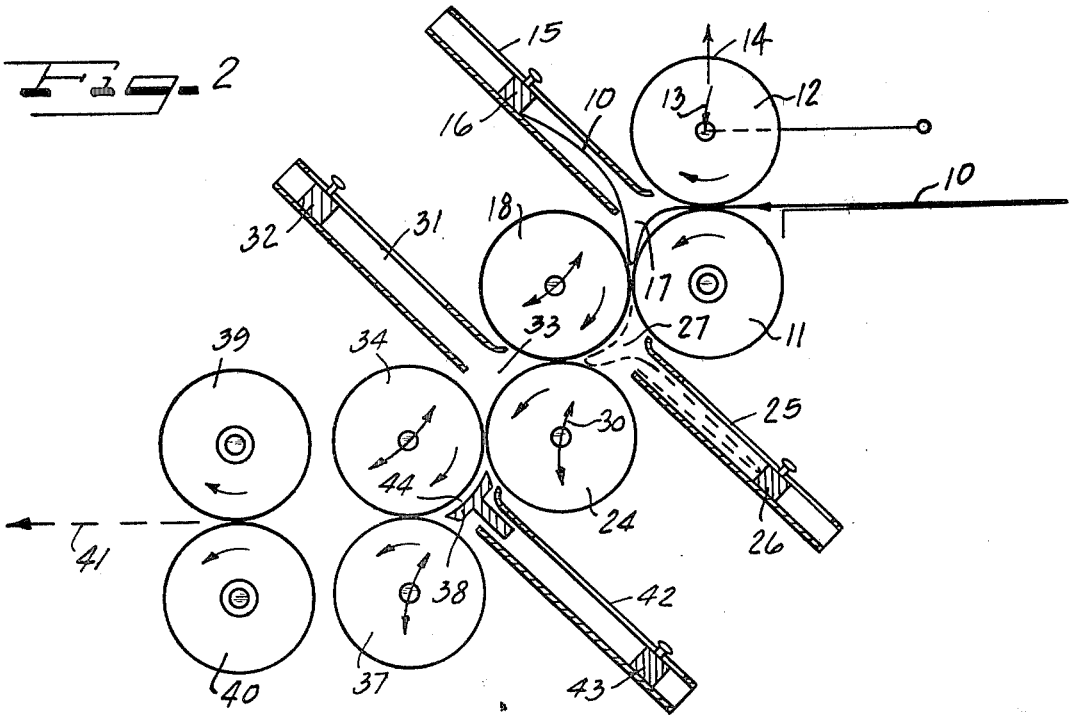
FIG. 2 is a schematic diagram of the prior art arrangement shown in FIG. 1.

The problem with a machine of the type just described in connection with FIGS. 1 and 2 is the difficulty in setting up the machine to run. For example, if any one of the adjustable rolls 18, 24, 34 or 37 is adjusted, all or most of the remaining rolls must similarily be readjusted. After all the rolls have been readjusted, test running usually indicates minor adjustments are still required and if any roll setting is further modified, all or most of the other rolls must similarly be modified. This obviously presents a real difficulty insofar as loss of time is concerned in a shop where a great variety of paper stocks are processed.

Figure 3:
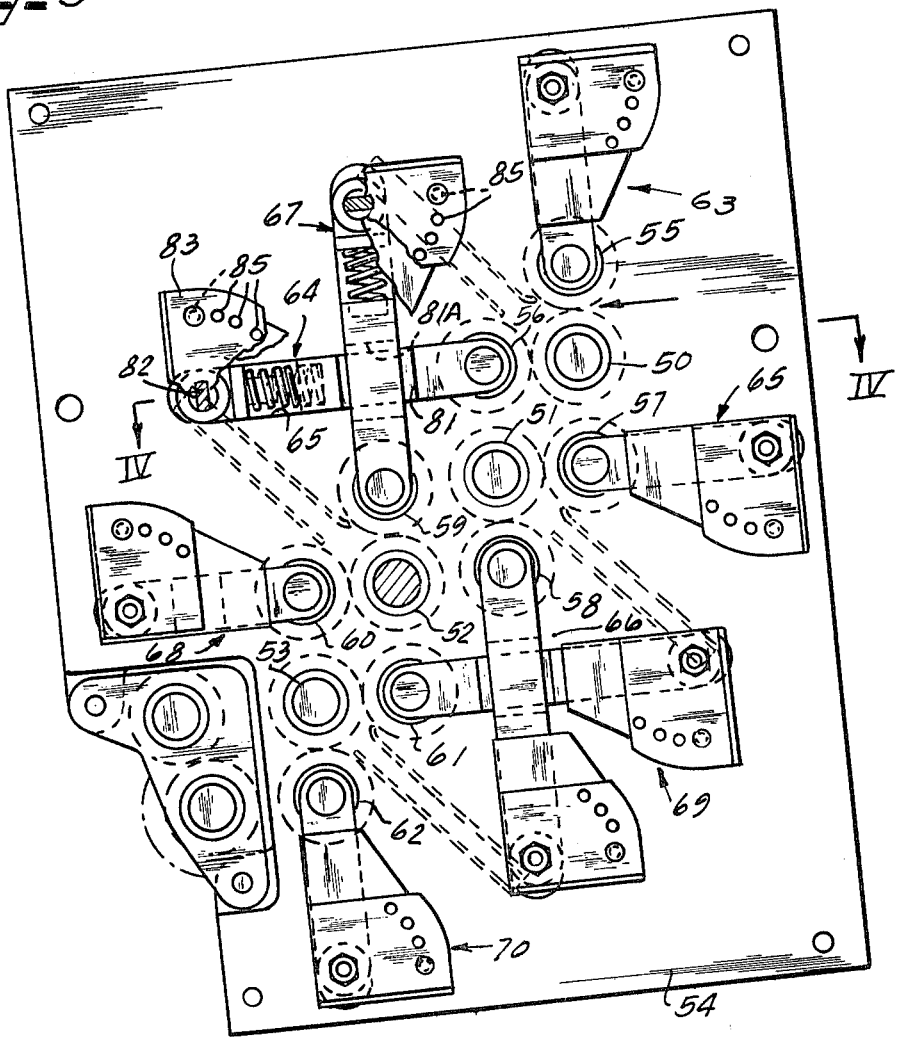
FIG. 3 is an end view in elevation showing a drive train in a paper folding machine embodying the present invention wherein the adjustable rolls are individually adjustable with respect to their associated main drive roll.
Figure 5:
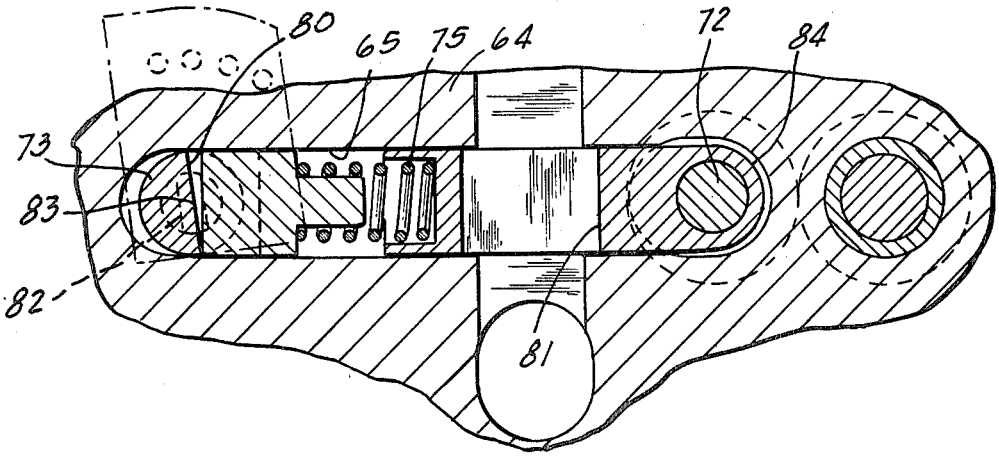
FIG. 5 is an enlarged partial sectional view taken along line 5—5 of FIG. 4.
Figure 6:
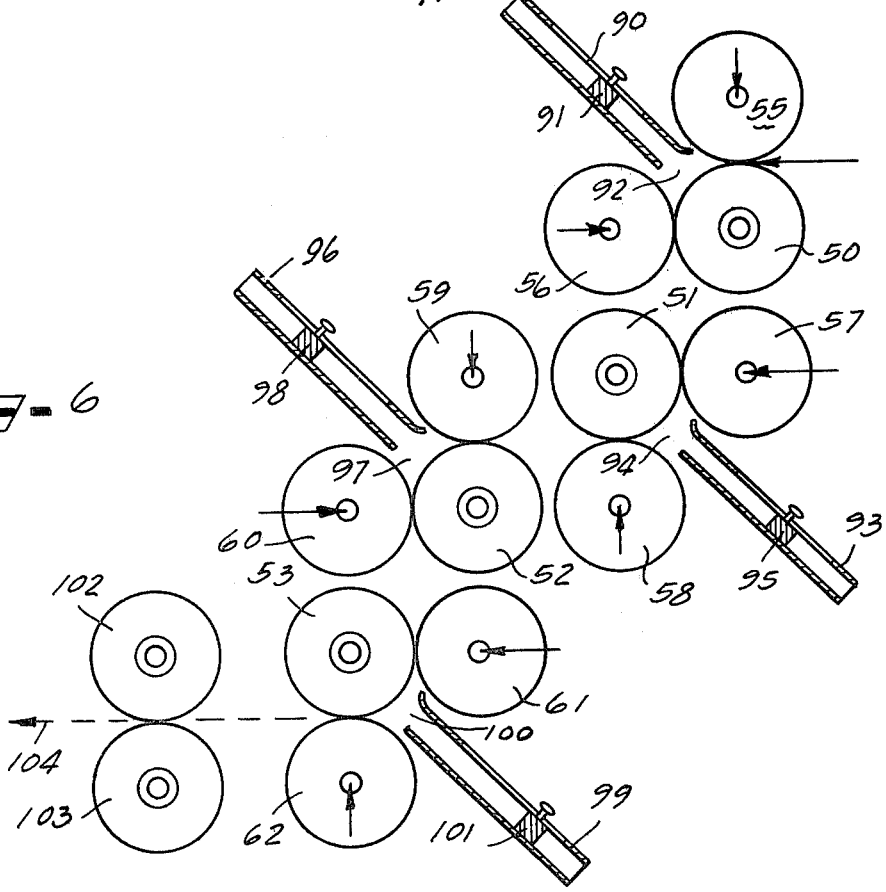
FIG. 6 is a schematic diagram of the drive train arrangement of FIG. 3.

With an arrangement embodying my invention the adjustability of the rolls are not interdependent on each other. I have found that the same tasks performed, for example, by the device described in FIGS. 1 and 2 can be accomplished with an arrangement such as is shown in FIGS. 3 to 6. With the arrangement of FIGS. 3 and 6, I utilize four main rolls 50, 51, 52, and 53 which are rotatably in the machine frame 54 in a suitable manner. An example of a structure which may be used is shown in FIG. 3. FIG. 6 shows a diagrammatic illustration of the structure of FIG. 3. Each of the main rolls 50, 51, 52 and 53 has a cluster of two adjustable rolls associated with it. The adjustable rolls in each case may be spaced substantially 90° apart using the axle of the associated main roll as a reference center. Both of the adjustable rolls are spring biased against their respective main rolls. In this arrangement the main roll 50 has adjustable rolls 55 and 56 associated with it. The main roll 51 has rolls 57 and 58 associated with it. The main roll 52 has rolls 59 and 60 associated with it. The main roll 53 has adjustable rolls 61 and 62 associated with it. The main rolls are not adjustable. The cluster of two rolls associated with each main roll are adjustable and each of the adjustable rolls is provided with an adjuster assembly.

Each of the adjustable rolls has an adjuster assembly associated with it as follows:

| Adjuster Assembly | Roll |
|---|---|
| 63 | 55 |
| 64 | 56 |
| 65 | 57 |
| 66 | 58 |
| 67 | 59 |
| 68 | 60 |
| 69 | 61 |
| 70 | 62 |

Figure 4:
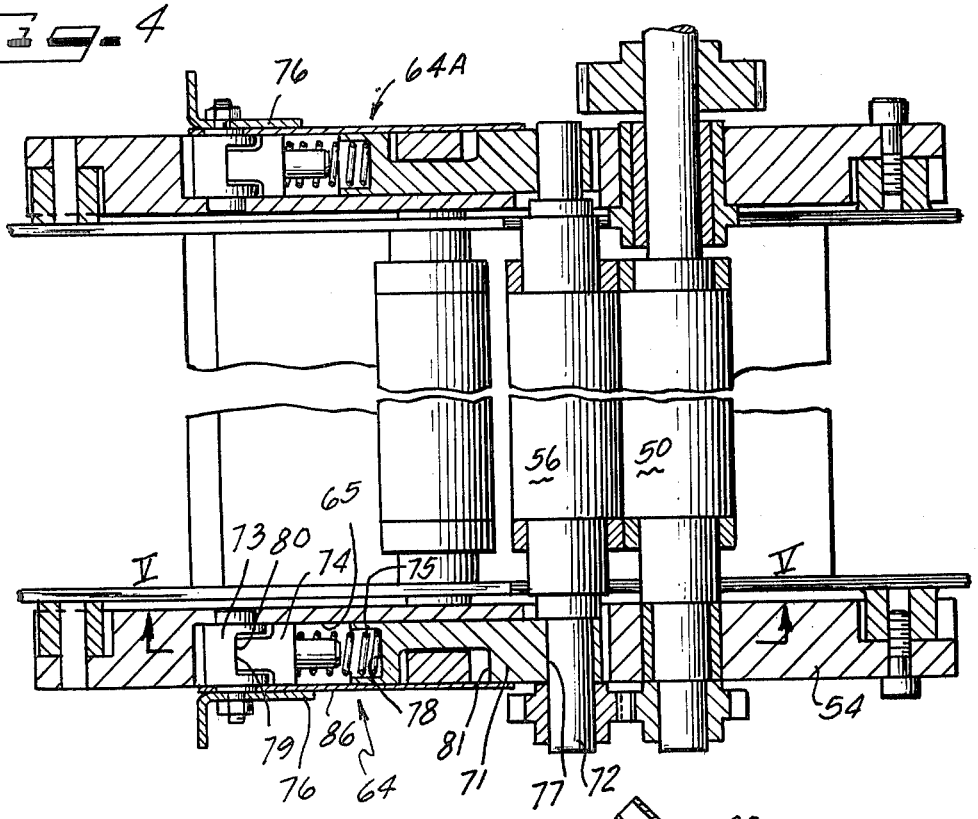
FIG. 4 is a plan view in section of a portion of a folding machine taken along line 4—4 of FIG. 3 showing the roller adjustment mechanism.

A preferred form of adjuster assembly 64 is shown in FIG. 4 disposed in a recess or cavity 65 in the frame 54. This preferred form of the adjuster assembly comprises a bearing arm 71 attached to the end of the adjusting roll shaft 72, a rotatable cam 73, a cam follower 74, a compression spring 75 disposed between the bearing arm 71 and the cam follower 74 and an operating lever 76 for rotating the cam. One end of the bearing arm 71 has a bore 77 formed therein to receive the end of the adjusting roll shaft 72 therethrough. The other end of the arm 71 is formed with a recess 78 for receiving one end of the spring 75 therein.

The rotatable cam 73 is a substantially cylindrical member formed with a bearing at each end for rotatable mounting in the frame 54. The cam 73 is formed with a transversely extending slot 79 which, in the adjuster assembly, contacts one end of the cam follower 74, the other end of the cam follower being engaged by the end of the spring 75.

The bearing arm 71 is also formed with a slot portion 81 so that a corresponding bearing arm of the adjuster assembly 67 (as seen in FIG. 3) also having a slotted portion 81A, may be fitted therein and perpendicular to the bearing arm 71. In other words, this permits bearing arms of the adjuster assemblies 64 and 67, for example, to lie in the same plane and cross each other without any interference. The outer end of the cam 73 is formed with an out of round lug 82 which may be square or rectangular, for example, for receiving thereon the cam operating lever 76. Rotation of the lever 76 is effective to rotate the cam to move the flat surface 80 of the slot portion 79 about the longitudinal axis 83 of the cam to contact and move the cam follower 74 which in turn may compress the spring 75 and cause linear movement of the bearing arm 71. The operating lever 76 has formed therein a plurality of adjustment holes 85 through which a pin may be inserted and plugged into an aperture in the frame, thereby holding the cam 73 in a desired position.

Normally two adjuster assemblies will be associated with each adjusting roll, namely one at each end as shown in FIG. 4. Adjuster assemblies 63A through 70A (not shown, with the exception of 64A) are at the other end of the adjustable rolls 55-62 respectively. Thus, in the unit described there would be 16 adjuster assemblies in all for the eight adjustable rolls.

It will be apparent, particularly from FIG. 4, that rotation of the operating lever 76 is effective to rotate the cam 73. Then when the cam 73 is rotated the rotation of the flat surface 80 of the cam which contacts the end of the cam follower is effective to move the cam follower linearly to compress the spring 75 and thus move the bearing arm 71 which carries the end 72 of the adjustable roll 56. This creates a greater pressure between the adjustable roll and associated main roll. FIG. 5 in particular shows how rotation of the surface 80 of the cam 73 is effective to necessarily move the cam follower to the right.

It will be observed that at the right end of the cavity 65 a slight amount of space 84 is provided between the end of the bearing arm 71 and the end of the cavity 65 so that the bearing arm has room to move linearly in the cavity 65 and thus effect movement of the roll 56 in a direction transverse to its axis of rotation. A cover plate 86 may be provided to enclose the adjuster assembly in the cavity thus keeping debris out of the cavity.

Each of the adjuster assemblies functions substantially the same as the adjuster assembly 64 to apply a desired pressure between the adjustable roll (with which it is associated) and the main roll with which the adjustable roll is associated. It will be apparent that each of the adjustable rolls are individually and independently adjustable for spring biasing. Furthermore, it will be observed from the layout in FIGS. 3 and 6 that the adjustment of one adjustable roll 56, for example, may be made without having an effect on the position of the adjustable roll 51 or on any of the other adjustable rolls. In the same manner, each of the adjustable rolls may be adjusted for the proper biasing effect of the adjustable roll in relation to its associated main roll. Such an arrangement avoids the problem discussed above with a typical convention drive train arrangement shown in FIGS. 1 and 2. In other words, when one roll is adjusted the position of the other adjustable rolls is no longer affected.

The path of a product to be folded four times will now be described. A full sheet is nipped by roll pair main roll 50 and adjustable roll 55. The sheet then enters the fold plate 90, stops at adjustable back stop 91, buckles in the area 92, enters roll pair main roll 50 and adjustable roll 56 and continues on to roll pair main roll 51 and 57. When it exits from the latter pair of rolls, the once folded paper enters fold plate 93, buckles in the area 94, stops at the back stop 95, is nipped by roll pair main roll 51 and adjustable roll 58, and exits into roll pair main roll 52 and 59. The sheet has now been folded twice. The now twice folded sheet exits from roll pair 52 and 59 and enters the fold plate 96, buckles in the area 97, stops at back stop 98, and enters roll pair main 52 and 60. As it exits from the latter pair, the now thrice folded paper enters roll pair main roll 53 and 61 and upon exiting therefrom enters fold plate 99, stops at 101 and buckles in area 100. The now four folded sheet proceeds through roll pair main roll 53 and 62 into special processing rolls 102 and 103 and exits at point 104. Deflectors such as 38 shown in FIG. 2 can be used or excluded at any one, all, or in combination at fold plates 90, 93, 96 or 99.

All of the rolls are adjustable with respect to spring pressure but each roll is independently adjustable with no adjustable roll depending for its positioning upon any other adjustable roll. It will be apparent that such an arrangement is a superior arrangement to one of the type described with reference to FIGS. 1 and 2 wherein an adjustment to any one of the rolls has an effect on the other rolls thus requiring their readjustment.

While a preferred embodiment of the invention has been disclosed, it will be appreciated that this has been shown by way of example only, and the invention is not to be limited thereto as other variations will be apparent to those skilled in the art and the invention is to be given its fullest possible interpretation within the terms of the following claims.

I claim as my invention:

1. A folding machine having a frame comprising a plurality of main rolls rotatably mounted in the machine frame, a cluster of two adjustable rolls associated with each main roll, independent roll adjusting means associated with each adjustable roll, including elongated bearing arm means attached to an end of each adjustable roll and disposed substantially normal thereto; and means for reciprocally moving said bearing arm means to effect movement of said adjustable roll transversely to its axis of rotation, said elongated bearing arm means being formed with a recessed portion constituting a transverse passageway passing a second elongated bearing arm means forming a portion of an independent roll adjusting means associated with another adjustable roll whereby the latter may intersect said first elongated bearing arm means.

* * * * *